US006350939B1

(12) United States Patent
Griffiths

(10) Patent No.: US 6,350,939 B1
(45) Date of Patent: Feb. 26, 2002

(54) NECK BLOCK SYSTEM FOR ACOUSTIC STRINGED INSTRUMENTS

(76) Inventor: Chris Griffiths, c/o Griffiths Guitars International Ltd. 117 Ropewalk Lane P.O. Box 26027, St. John's, Newfoundland (CA), A1E 5T9

( * ) Notice: Subject to any disclaimer, the term of this patent is extended or adjusted under 35 U.S.C. 154(b) by 0 days.

(21) Appl. No.: 09/759,302

(22) Filed: Jan. 16, 2001

(51) Int. Cl.[7] ..... G10D 3/00
(52) U.S. Cl. ..... 84/293; 84/291; 84/290
(58) Field of Search ..... 84/293, 291, 290

(56) References Cited

U.S. PATENT DOCUMENTS 4,939,970 A * 7/1990 Hoshino et al. ..... 84/293
5,353,672 A * 10/1994 Stewart ..... 84/291
5,452,637 A * 9/1995 DeCola ..... 84/291
5,469,770 A * 11/1995 Taylor ..... 84/291
5,949,005 A * 9/1999 Peterson ..... 84/291
6,051,766 A 4/2000 Taylor ..... 84/293
6,233,825 B1 * 5/2001 DeGroot ..... 29/896.22

* cited by examiner

*Primary Examiner*—Shih-Yung Hsieh
(74) *Attorney, Agent, or Firm*—Ridout & Maybee LLP

(57) ABSTRACT

A neck block system for securing the neck of an acoustic stringed instrument to a body of the stringed instrument has a substantially hollow block having an open face on a body side of the neck block, a receiving member projecting inwards from a neck wall of the neck block, and a plurality of bracing members reinforcing the receiving member to the neck wall. The neck block system provides a larger hollow, a strong attachment, a lighter instrument and improved sound quality. The neck block is a single piece of rigid molded material. A binding strip having a strip key is configured to key with the neck block such that the neck block system is suitable for both a right cutaway and a left cutaway stringed instrument. Dowel members protrude from the neck wall for keying with a corresponding aperture located in a neck of the stringed instrument.

20 Claims, 4 Drawing Sheets

NECK BLOCK SYSTEM FOR ACOUSTIC STRINGED INSTRUMENTS

FIELD OF THE INVENTION

The invention relates to a neck block system for securing the neck of an acoustic stringed instrument, such as a guitar, to the body of the instrument.

BACKGROUND OF THE INVENTION

An acoustic stringed instruments, such as a guitar, typically has two main structural components, a neck and a body. Within the internal cavity of an acoustic guitar there are many structural bracing and support members (braces) which are typically made out of wood. The majority of these braces are thin strips fixed with adhesive to the soundboard or the back of the guitar, and don't significantly contact the sides. There are two exceptions. At the point where the neck joins the body and at the opposite end of the body cavity where the two side sections join, there are internal blocks which are required to take significant structural loading. These are often referred to as the neck block and the end block. These blocks are typically of a much larger cross-section than the braces that are fixed to the soundboard and back. These blocks are typically machined from various species of wood using jigs and fixtures.

The neck block provides the structural integrity required to fix the neck to the body of the guitar and withstand the forces induced through the string tension. This makes the neck block a critical component in determining the stability of the guitar over time.

Furthermore, the integrity of the join between the neck and the body is critical in accurately and efficiently transmitting vibrations between the neck and the body of the guitar. In addition, the "set", or angle that the neck is fixed to the body can have a huge impact on the performance of the guitar. The neck set can affect tone, intonation (the guitar's ability to stay in tune with itself as various chords are played up the neck) and structural integrity because it affects the string's overall tension and the distance of the strings from the top of the body as well as the way they vibrate.

Traditionally, the acoustic guitar's neck is attached to the neck block of the body of the guitar using a basic mortice and tenon joint or by using a dovetail joint in order to build strength and long term reliability. Machining a neck block requires multiple steps and significant time investment from a skilled craftsman.

Under significant tension from the strings when tuned to pitch (about 150 lbs), the joint where the neck meets the body is under constant tension and susceptible to long term changes in temperature and humidity which negatively affect its long term stability and as such the accuracy of the neck set over time.

As shown in FIG. 1, prior art, companies have tried to increase manufacturing flexibility and strength by introducing bolt-on neck blocks for guitars. The neck 20 is bolted to the neck block 22 by means of one or more bolts 24. Neck block 22 is, in turn, affixed to the front and back panels 26 and the sides of the body 28, usually by an adhesive. Due to the significant tension the neck block must withstand, the size of the block is maximized. In left and right-hand cut-a-way models the block must be subsequently cut down to accommodate the cutaway. Decreasing the size of the neck block, however, decreases its much needed strength.

U.S. Pat. No. 6,051,766 to Taylor provides for different sized spacers in recesses where the neck and body meet and bolts that connect the neck and body. However, this invention relies on an L-shaped neck block and neck. This requires lengthy machining processes on both parts (the neck and the neck block) and does not reduce the fluctuations that the neck is exposed to under different temperature and humidity situations. This neck block system does allow for easier adjustment and repair of the neck set as it changes over time due to fluctuations in temperature and humidity, but does little to increase structural stability.

SUMMARY OF THE INVENTION

The present invention provides a neck block system for securing a neck of an acoustic stringed instrument having a hollow body to the body of the acoustic stringed instrument, comprising a substantially hollow neck block having an open face on a body side of said neck block, a receiving member on a neck wall of said neck block, said receiving member comprising an aperture through said neck wall and said receiving member having member walls projecting inwards from said neck wall, and a plurality of bracing members reinforcing said receiving member to said neck wall of said neck block. The neck block may be a single piece of rigid molded material.

A front wall may project perpendicular from the neck wall of the neck block, and a rear wall may project perpendicular from the neck wall of the neck block. A locating slot on the front wall and a locating slot on the rear wall may be configured for keying with corresponding protrusions located in the body of the stringed instrument. The locating slots may be configured in a T shape. The neck block may have a top wall projecting perpendicular from the neck wall of the neck block, and a bottom wall projecting perpendicular from the neck wall of the neck block. A shoulder on the top wall and a shoulder on the bottom wall may be configured to key with corresponding protrusions located in the body of the stringed instrument. In an embodiment, the bracing members are each arranged perpendicular to the receiving member and perpendicular to the neck wall.

The invention further teaches a binding strip having a heel strip, a wall strip, and a strip key, the heel strip joined lengthwise at a right angle, wherein the neck block has a strip indentation configured to key with the strip key, and the binding strip and neck block are configured such that the neck block system is suitable for any of a right cutaway, a left cutaway or a non-cutaway stringed instrument.

The neck block system may have a dowel member protruding outwardly from the neck wall opposite the receiving member, wherein the dowel member is configured to key with a corresponding aperture located in the neck of the stringed instrument.

A corner shoulder at the corner of the neck wall may be configured for keying with a corresponding body frame in the body of the stringed instrument. In one embodiment, there is a corner shoulder at each corner of the neck wall. In another embodiment, there is a neck wall shoulder located along an edge where the neck wall joins the front wall and a neck wall shoulder located along an edge where the neck wall joins the rear wall and the neck wall shoulders are each configured for keying with a corresponding body frame in the body of the stringed instrument.

The invention also teaches a neck block system for securing the neck of an acoustic stringed instrument having a hollow body to the body of the acoustic stringed instrument, comprising a substantially hollow walled structure, a receiving member projecting inwards from a neck wall of the walled structure, and a plurality of bracing members reinforcing the receiving member to the neck wall of the neck block, wherein the walled structure has an open face on a body side of the neck block. The neck block may be a single piece of rigid molded material. The walled structure may have walls on five sides.

The invention also teaches a neck block system for securing a neck of an acoustic stringed instrument having a hollow body to the body of the acoustic stringed instrument, comprising a walled structure having a neck wall and a dowel member protruding outwardly from the neck wall, the dowel member configured to key with a corresponding aperture located in a neck of the stringed instrument.

BRIEF DESCRIPTION OF THE DRAWINGS

A preferred embodiment of the invention will be described with reference to the accompanying drawings, in which.

DETAILED DESCRIPTION OF EMBODIMENTS

Figure 1:
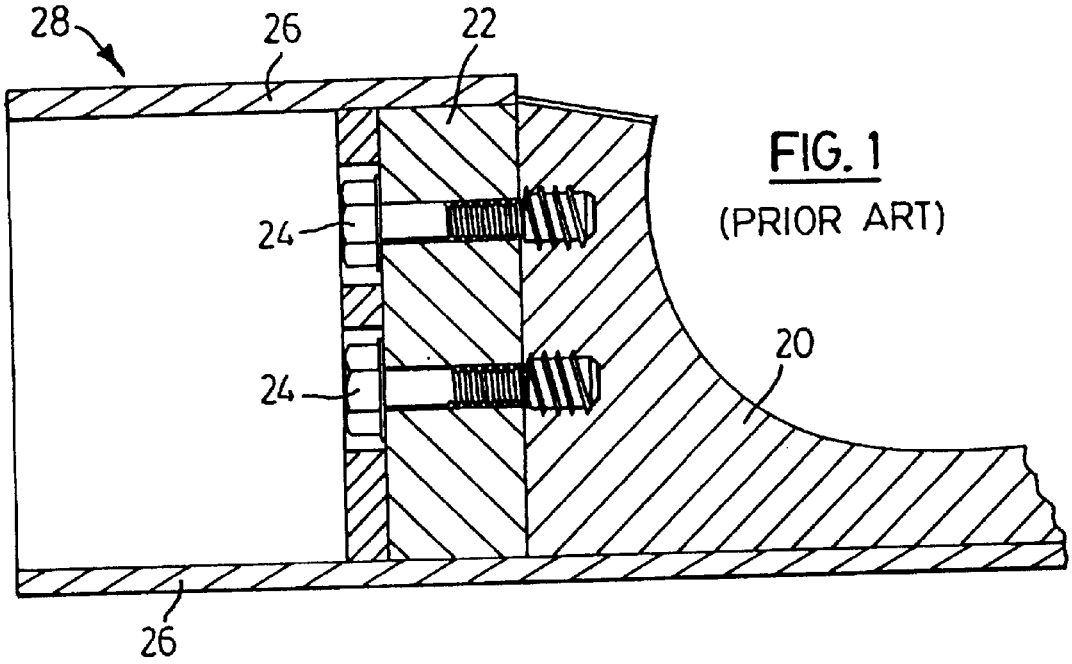
FIG. 1 (PRIOR ART)
FIG. 1 is a cross section of a neck block joining a neck to a body of an acoustic stringed instrument according to the prior art.

The present invention provides an improved means for attaching the neck of an acoustic stringed instrument to the body of an acoustic stringed instrument. The new neck block is a thin-walled structure with support bracing. This minimizes the weight of the component while maximizing the geometric volume of the sound chamber and providing stiffness where required. Several new features are introduced that enhance the structural stability, the locating accuracy and the consistency of the neck-to-body connection. Furthermore, while these significant improvements add value and reliability for the end user and create a superior instrument, they also introduce significant benefits in the manufacturing process—saving time, reducing costs and increasing consistency and quality control in a meaningful and measurable way. The part is inexpensive to produce and can be used in left and right-hand cut-a-way models as well as standard, left hand or right-hand non-cut-a-way models without modification.

Preferred embodiments of the present invention will now be described in detail with reference to the appended drawings, in which like elements are denoted by like reference numerals.

Figure 2:
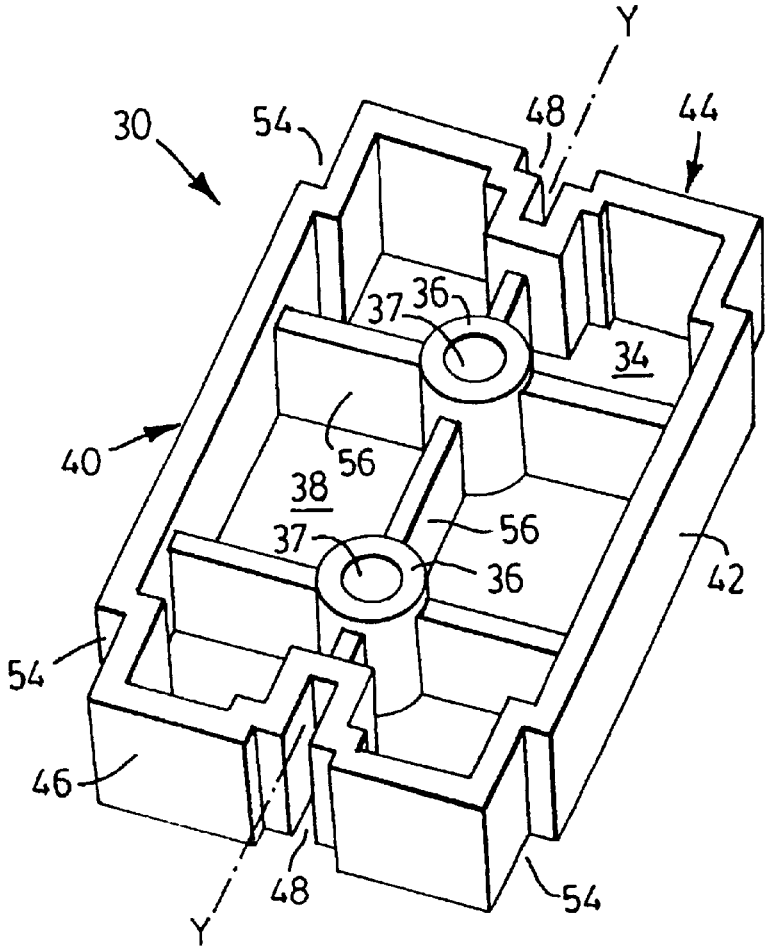
FIG. 2 is a perspective view taken at the body side of a neck block according to the present invention.

As shown in FIG. 2, the neck block 30 of the invention has a substantially hollow interior. FIG. 2 shows the body side 34 of the neck block, the body side being an open face which in use faces inwards into the body of the guitar or other stringed instrument. Two hollowed receiving members 36 are positioned along centerline Y. In other embodiments (not shown), one receiving member or more than two receiving members may be used. In the embodiment shown, members 36 have holes 37 extending lengthwise therethrough, and are suitable for receiving bolts, jacks, screws or other such fastening devices. In other embodiments, members 36 could be configured to receive rivets or the like. In still other embodiments, member 36 could be configured to be the female portion of a mortice and tenon joint or a dovetail joint. However, where bolts, screws or other jack means be used to fasten the neck of the instrument to the body of the instrument, these allow for removal and replacement of the neck from the body for repair and allow for tightening the attachment between the neck and the body as may be necessary with the passage of time and fluctuations in temperature and humidity.

Receiving members 36 are reinforced by bracing members 56 which are integral to the neck block 30 and project substantially perpendicular from neck wall 38. Bracing members are in turn reinforced by further being integral with other (i.e., more than one) receiving members 36 or integral with top wall 40, bottom wall 42, front wall 44 or rear wall 46. Bracing members 56 provide strength to receiving members 36 to withstand the substantial forces at the neck block, without requiring a solid (non-hollow) neck block. In the embodiment shown, each receiving member 36 has four bracing members 56 which are arranged perpendicular to adjacent bracing members. It will be appreciated that different bracing systems and different numbers of bracing members can be arranged within the substantially hollow structure of the neck block in place of those illustrated.

Figure 3:
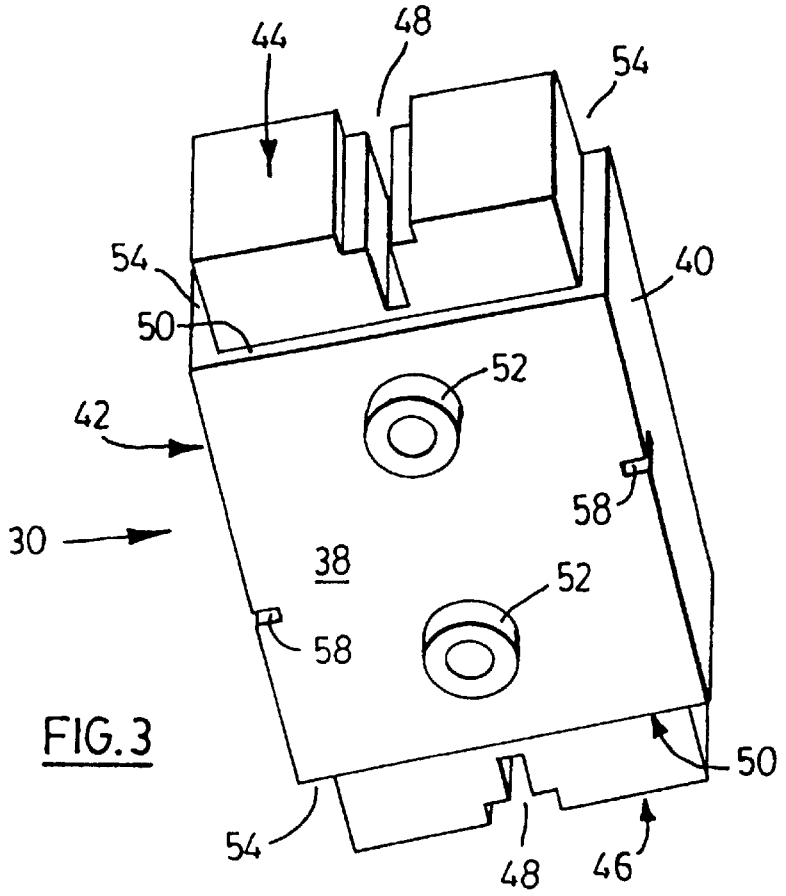
FIG. 3 is a perspective view taken at the neck side of a neck block according to the present invention.

In the embodiment best shown in FIG. 3, neck block 30 has five sides, comprising end wall 38, top wall 40, bottom wall 42, front wall 44 and rear wall 46. However, for some uses, the neck block system may not require five walls. At a minimum, one neck wall is required, with bolt or joint receiving means and bracing. It will be appreciated, however, that the front, rear, top and bottom walls, both individually and collectively (because they form one integral part), provide valuable strength and support to the neck block system. All five walls of the neck block can be gluing surfaces based on different configurations. Front wall 44 is a generally flat surface, corresponding to the flat surface of the interior of the instrument's front wall (i.e. the sound board). Rear wall 46 is slightly bowed to follow the bow normally found in the rear of the instrument (i.e. back board).

Figure 4:
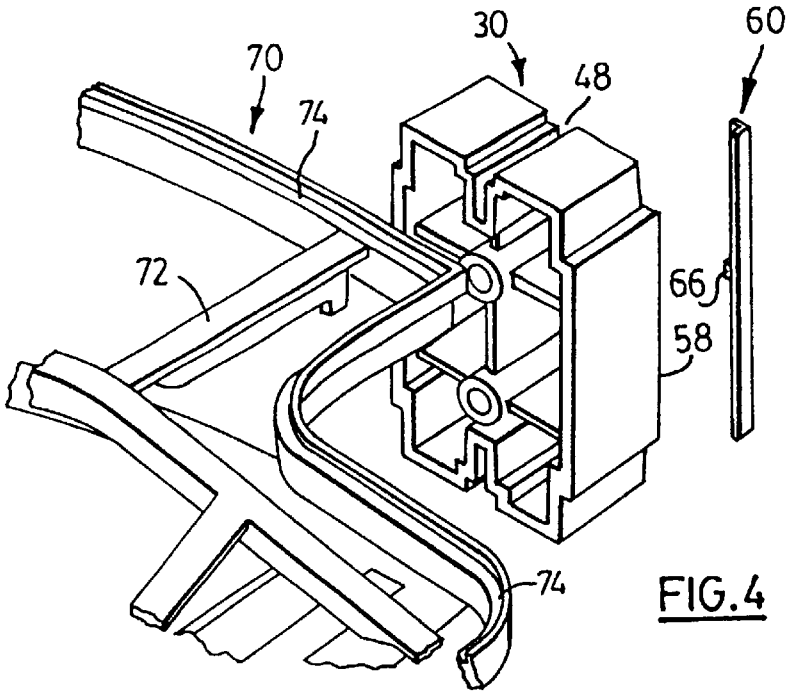
FIG. 4 is an exploded view of a neck block system according to the present invention in relation to a portion of a guitar body.

Also new over the prior art, locating slots 48 are incorporated into the front wall 44 and rear wall 46 of the neck block at the median of the neck block. These slots act as keying features to locate the neck block along a length of bracing located on the soundboard and back board of the body. This ensures that the orientation between the neck and body of the guitar or other instrument is square and consistent from one guitar to the next. These slots accept a central, foremost, T-brace 72 on bracing frames positioned in the interior of the body 70 to form a dado joint, as best seen in FIG. 4 (exploded) and FIG. 5 (assembled). This increases the strength of the bond between the neck block and the body of the instrument. While the present invention is illustrated with a T dado joint, it will be appreciated that other joints are suitable, such as a dovetail dado or a rabbet and dado joint.

Figure 5:
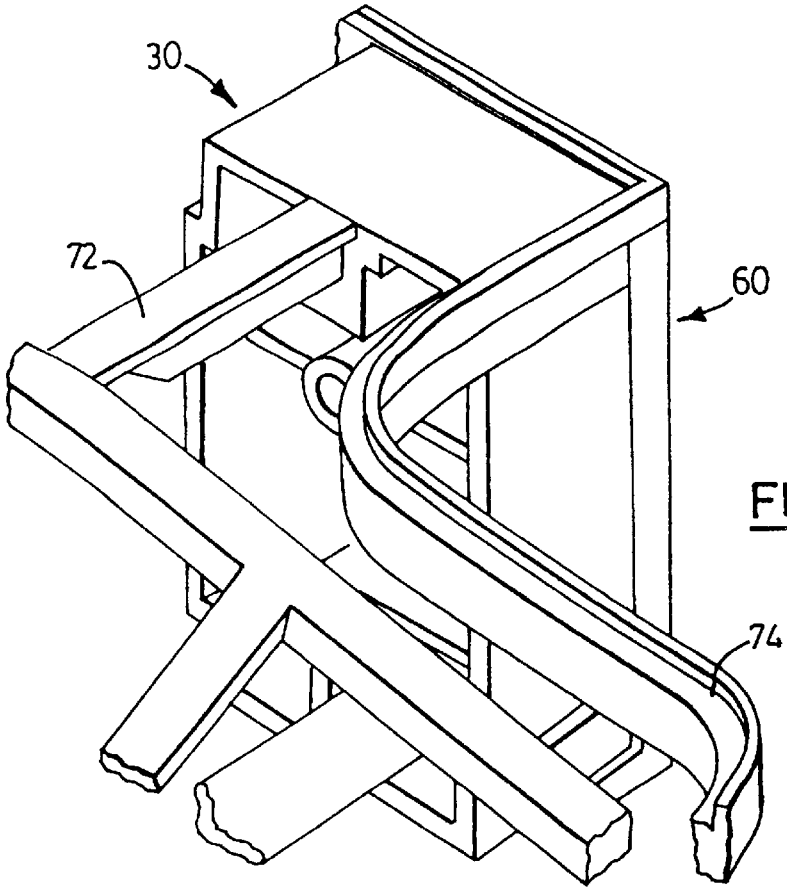
FIG. 5 is a perspective view of the showing a neck block system of FIG. 4, assembled.

A neck wall shoulder 50 is located between the neck wall 38 and the front wall 44, and another neck wall shoulder 50 is located between the neck wall 38 and the rear wall 46. The neck wall shoulder 50 is configured to key with body frame 74 to form a rabbet joint, as best seen in FIG. 4 (exploded)

and FIG. 5 (assembled). Corner shoulders 54 form edges between each of the bottom wall 42, rear wall 46, top wall 40 and front wall 44. The corner shoulders 54 are configured to key with body frame 74 to form a rabbet joint in left or right cutaway models, as best seen in FIG. 4 (exploded) and FIG. 5 (assembled).

As seen in FIG. 3, protruding dowel sections 52 key into matching holes in the neck of the instrument to ensure it is placed consistently in both vertical and horizontal positions and to reinforce the bolted joint. Inserting a portion of the neck block into the neck also increases tone transfer between the neck and the body of the instrument.

Figure 7:
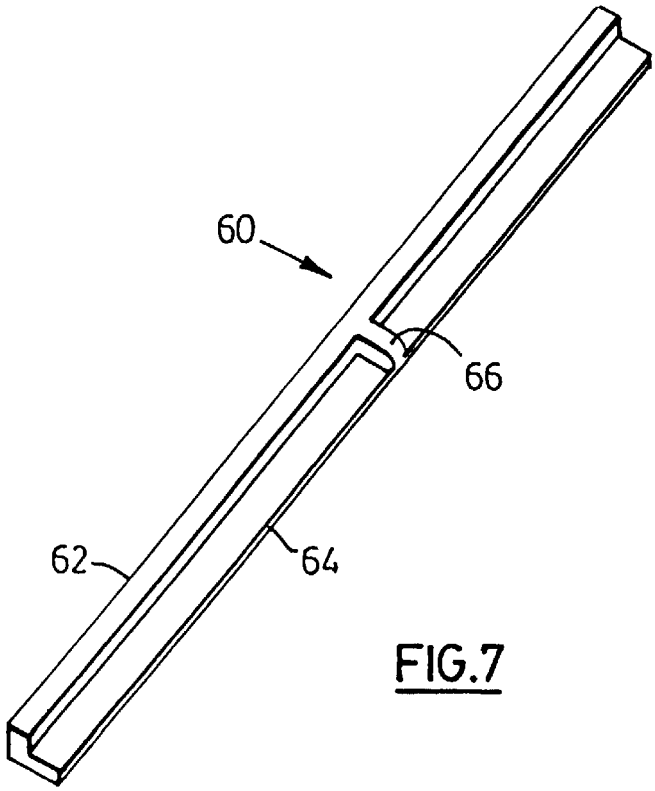
FIG. 7 is a perspective view of a binding strip according to the present invention.

In order to utilize a single molded block for cutaway configurations, a molded binding strip 60 has been designed, as shown in FIG. 7. The binding strip 60 has a heel strip 62 and a wall strip 64 which meet lengthwise at a right angle. The binding strip mostly serves a cosmetic purpose, covering the section where two thin pieces of wood meet at 90° angles.

With neck block systems of the prior art, manufacturers would add a binding strip using several separate steps, machining the binding strip to meet the dimensions required. In the system of the present invention, this preformed strip may be simply added to either the left or right forward edge of the neck block depending on the orientation of the cutaway. A strip key 66 on the binding strip 60 fits into a strip slot 58 on the face of the block to ensure that the strip is located appropriately. The same strip can be used for left and right-handed models by rotating it through 180 degrees and applying to the corner in question, as best seen in FIG. 4 (exploded) and FIG. 5 (assembled).

Other keying structures which are suitable for the invention may be used, so long as security of attachment is provided between the end block and the body of the instrument.

In production, the material that is injection molded is a long strand glass fibre with resin composite. Glass is utilized as it transmits vibrations very effectively. Other material may be suitable. For example, the neck block may be made from materials such as thermopolymers, graphite or the like.

Figure 6:
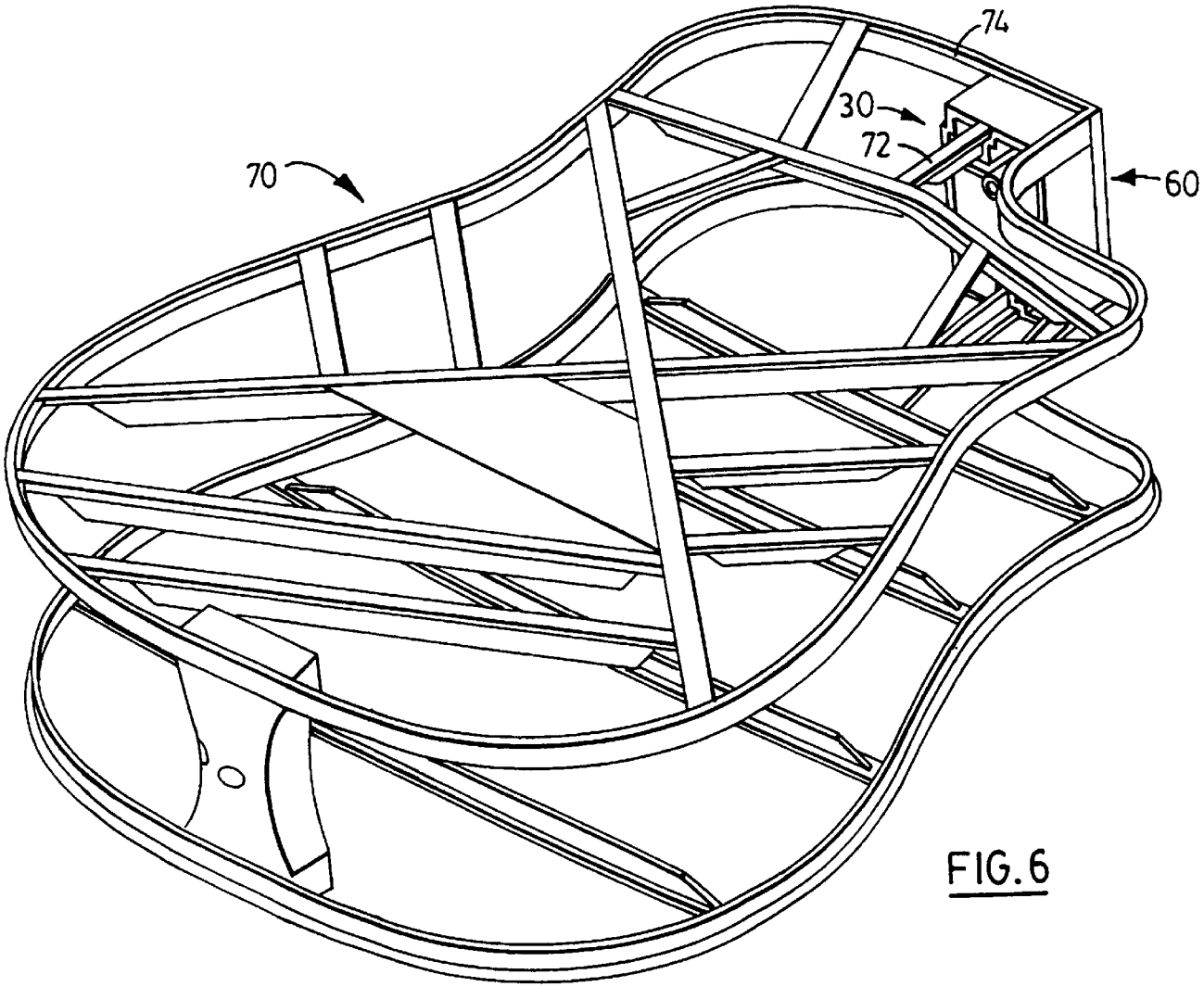
FIG. 6 is a perspective view of a neck block system according to the present invention in relation to a guitar body.

The neck block system of the invention is particularly suitable for use in association with the Griffiths Active Bracing System™ (GABS™), which is described in U.S. patent application Ser. No. 09/492,809 of the present inventor. This arrangement is best seen in FIG. 6. However, the neck block is also suitable as a simple replacement for traditional blocks. The neck block is easily modified to fit any manufacturer's acoustic line. If necessary, T-braces 72 can be readily affixed to the interior of bodies of the acoustic stringed instrument.

The present invention, as opposed to any other known means, provides other significant benefits.

The neck block has been designed as a thin-walled structure with support bracing. The neck block weighs less than prior art components of the same overall dimensions. This allows for a reduction in overall weight of the instrument while maximizing the geometric volume of the sound chamber (thus improving sound quality) and providing stiffness where required.

Locating slots 48 as well as shoulders 50 and 54 act as keying features to self index and to locate the neck block along the length of the bracing, binding, ribs or frame of the body to ensure that the instrument's overall structure is square and consistent from one guitar to the next, and to increase strength and durability. This allows for increased quality control during the assembly process as it ensures that the parts are correctly placed every time.

The male braces in the body of the guitar key with the corresponding female sections of the neck block. Due to the manner in which the neck block indexes with the front and back of the body of the guitar, the neck block system is vastly stronger than a traditional neck block as the kerfing, binding, rib, frame or brace sections of the bracing system add significant strength. In other words, the strength of the bracing, having locked into place with the neck block, resists the tension of the strings as opposed to traditional methods which rely solely on the strength of the neck block and the surfaces of the body to which it is glued.

The protruding dowel section keys into matching holes in the neck to ensure it is placed consistently in both vertical and horizontal positions and reinforcing the bolted joint. Tone transfer between the body and the neck is enhanced with this design as the surface area is increased, the neck block has meaningful contact with the braces/bracing system of the body, such as T-brace 72 and body frame 74, while the locating/mating dowel sections 52 in the neck block are countersunk in the neck upon attachment creating even more surface area where the two parts interact.

In normal acoustic guitar manufacturing, separate neck blocks would have to be designed and machined to accommodate for right and left-hand cut-a-way guitars. The neck block system of the present invention has been designed to work equally well for both standard and cutaway configurations (left and right). This means that of the six main "surfaces" of the block, all but the inner surface are potentially gluing surfaces. Each has been carefully designed to accommodate the appropriate mating part (e.g., kerfing, binding, frame, soundboard, back, and sides). Traditionally, different blocks are made to accommodate the three different configurations. With the neck block system of the present invention, the same block can be used for all body styles (left and right standard guitars as well as left and right-hand cut-a-ways).

The molded-in features allow for easy assembly of the binding strip to the neck block, as compared to the prior art which requires several manufacturing, machining and/or assembly steps. In the prior art, manufacturers would perform this operation (i.e., adding a bind strip) in several separate steps. In the case of the neck block system of the present invention, this strip is added to either the left or right forward edge of the neck block depending on the orientation of the cutaway. The tab on the binding strip fits into a slot on the face of the block to ensure that the strip is located appropriately. The same strip can be used for left and right-handed models.

The blocks can be injection molded instead of machined which results in extremely fast cycle/manufacturing times for the part (approximately 20–25 seconds each). The parts produced are the same every single time. The neck block may be cast from a desired material, and is then ready for assembly. No drilling puncturing or machining is required, reducing the cost of producing the neck block.

The holes for the neck bolts are preformed in the neck block to eliminate the drilling process from the construction task. This feature also helps to ensure that the structure is consistent from one guitar to the next.

In an embodiment, the material that is injection molded is a long strand glass fibre with resin composite. Glass is utilized for this part as it transmits vibrations very effectively, providing improved sound quality, and it is very strong when added with the resin composite. With injection molding, different types of glass fibre and resin composites can be used to modify the strength and tone transfer between the body and the neck.

Another benefit of the present means for attachment is that the neck block system can be used with traditional guitar designs. No special adaptation of the neck or body is required.

The above description with reference to the illustrations is considered to be illustrative and not restrictive in character. The true scope and spirit of the invention resides in the appended claims and their legal equivalents, rather than by the given examples. Modifications and variations on the embodiments described or known to those skilled in the art may be made within the scope of the invention.

I claim:

1. A neck block system for securing a neck of an acoustic stringed instrument having a hollow body to the body of the acoustic stringed instrument, comprising a substantially hollow neck block having an open face on a body side of said neck block, a receiving member on a neck wall of said neck block, said receiving member comprising an aperture through said neck wall and said receiving member having member walls projecting inwards from said neck wall, and a plurality of bracing members reinforcing said receiving member to said neck wall of said neck block.

2. A neck block system as claimed in claim 1, wherein said neck block is a single piece of rigid molded material.

3. A neck block system as claimed in claim 1, wherein said neck block further comprises a front wall projecting perpendicular from said neck wall of said neck block, and a rear wall projecting perpendicular from said neck wall of said neck block.

4. A neck block system as claimed in claim 3, wherein said neck block further comprises a locating slot on said front wall and a locating slot on said rear wall, said locating slots configured for keying with corresponding protrusions located in the body of said stringed instrument.

5. A neck block system as claimed in claim 4, wherein said locating slots are configured in a T shape.

6. A neck block system as claimed in claim 1, wherein said neck block further comprises a top wall projecting perpendicular from said neck wall of said neck block, and a bottom wall projecting perpendicular from said neck wall of said neck block.

7. A neck block system as claimed in claim 6, wherein said neck block further comprises a shoulder on said top wall and a shoulder on said bottom wall, said shoulders configured to key with corresponding protrusions located in the body of said stringed instrument.

8. A neck block system as claimed in claim 1, wherein said bracing members are each arranged perpendicular to said receiving member and perpendicular to said neck wall.

9. A neck block system as claimed in claim 1, wherein said neck block further comprises a binding strip having a heel strip, a wall strip, and a strip key, said heel strip joined lengthwise at a right angle, and wherein said neck block has a strip indentation configured to key with said strip key, and said binding strip and neck block are configured such that the neck block system is suitable for either a right cutaway and a left cutaway stringed instrument.

10. A neck block system as claimed in claim 1, wherein said neck block comprises a dowel member protruding outwardly from said neck wall and said dowel member is configured to key with a corresponding aperture located in the neck of said stringed instrument.

11. A neck block system as claimed in claim 1, further comprising a corner shoulder at the corner of said neck wall, said corner shoulder configured for keying with a corresponding body frame in the body of said stringed instrument.

12. A neck block system as claimed in claim 11, further comprising a corner shoulder at each corner of said neck wall.

13. A neck block system as claimed in claim 1, further comprising a neck wall shoulder located along an edge where the neck wall joins the front wall and a neck wall shoulder located along an edge where the neck wall joins the rear wall and said neck wall shoulders are each configured for keying with a corresponding body frame in the body of said stringed instrument.

14. A neck block system for securing a neck of an acoustic stringed instrument having a hollow body to the body of the acoustic stringed instrument, comprising a substantially hollow walled structure, a receiving member projecting inwards from a neck wall of said walled structure, and a plurality of bracing members reinforcing said receiving member to said neck wall of said neck block, wherein said walled structure has an open face on a body side of said neck block.

15. A neck block system as claimed in claim 14, wherein said neck block is a single piece of rigid molded material.

16. A neck block system as claimed in claim 14, wherein said neck block further comprises a locating slot on said walled structure, said locating slot configured for keying with a corresponding protrusion located on said body of said stringed instrument.

17. A neck block system as claimed in claim 14 wherein said bracing members are each arranged perpendicular to said receiving member and perpendicular to said neck wall.

18. A neck block system as claimed in claim 14, wherein said neck block comprises a dowel member protruding outwardly from said neck wall and said dowel member is configured to key with a corresponding aperture located in a neck of said stringed instrument.

19. A neck block system as claimed in claim 14, wherein said walled structure has walls on five sides and a shoulder on each wall, said shoulders configured for keying with corresponding protrusions located on said body of said stringed instrument.

20. A neck block system for securing a neck of an acoustic stringed instrument having a hollow body to the body of the acoustic stringed instrument, comprising a walled structure having a neck wall and a dowel member protruding outwardly from said neck wall, said dowel member configured to key with a corresponding aperture located in a neck of said stringed instrument.

* * * * *